US005493963A

United States Patent [19]

Curles et al.

[11] Patent Number: 5,493,963

[45] Date of Patent: Feb. 27, 1996

[54] HIGH PRODUCTION DOUBLE LIFT BOX BALER

[75] Inventors: Curtis T. Curles, Cordele, Ga.; Paul R. Sexton, Etowah; David P. Zachary, Brevard, both of N.C.

[73] Assignee: Fishburne International, Inc., Arden, N.C.

[21] Appl. No.: 421,410

[22] Filed: Apr. 13, 1995

[51] Int. Cl.[6] ..... B30B 9/30

[52] U.S. Cl. ..... 100/215; 100/218; 100/220; 100/223; 100/229 R; 100/251

[58] Field of Search ..... 100/193, 215, 100/218, 220, 221, 223, 229 R, 251

[56] References Cited

U.S. PATENT DOCUMENTS

| | | | |
|---|---|---|---|
| 1,738,326 | 12/1929 | Smith | 100/229 R |
| 2,169,667 | 8/1939 | Streun | 100/220 |
| 2,171,724 | 9/1939 | Grimes | 100/223 |
| 2,175,075 | 10/1939 | Blewett | 100/223 |
| 2,757,601 | 8/1956 | Deems | 100/220 |
| 2,782,711 | 2/1957 | Heizer, Jr. et al. | 100/229 R |
| 2,963,959 | 12/1960 | Van Doorn et al. | 100/223 |
| 4,463,669 | 8/1984 | Van Doorn et al. | 100/229 R |

*Primary Examiner*—Stephen F. Gerrity
*Attorney, Agent, or Firm*—Cort Flint

[57] ABSTRACT

A high production, double lift box baler having a pair of lift box assemblies which rotate between a charging position and a compression position. Each lift box assembly includes a lift box and a displaceable lower platen which has a latched position in which the lower platen forms a floor of the lift box. Each lower platen also has an unlatched position in which the lower platen is independently displaced to rest against a bottom sill during a compression cycle to withstand the compression forces. The lower platens are independently displaceable, so that while one platen is displaced against the bottom sill for compression, the other sill is latched and is utilized as a floor for tramping the fibers during a filling cycle. A latch assembly is provided for unlatching the lower platen at the compression position during a compression cycle, and for latching the lower platen integrally to the lift box for rotation and tramping. A unique bottom sill extends only across a part of a width of the baler and provides open access to the actuators and rotational drive of the baler for servicing.

33 Claims, 18 Drawing Sheets

HIGH PRODUCTION DOUBLE LIFT BOX BALER

BACKGROUND OF THE INVENTION

This invention relates to a fiber baler, and more particularly to a double lift box baler in which individual, independently displaceable lower platens are utilized which simplify the construction and provide increased reliability and production.

In the baling of cotton and other fibers, one form of apparatus commonly used employs a pair of lift boxes mounted side-by-side on a turntable. The boxes are rotated on the turntable between a charging position and a compression position at which the respective boxes are positioned beneath a fiber tramping assembly and a fiber compression ram assembly. During the charging and tramping cycle, the box is repeatedly filled and tramped while successive deposits of fibers are held in place by fiber retaining dogs. Once the box is filled, it is rotated to the compression position. While the fibers in the lift boxes are being tramped and compressed, the turntable rests on a bottom sill across the full width of the bales to withstand the compression forces. After the bale is compressed and removed from the baler, it is necessary to lift the turntable and both lift boxes. This lifting operation requires a relatively complicated lifting mechanism and substantial power to lift the turntable and lift boxes during rotation. Previously, this has resulted in very complicated lifting mechanisms and balers wherein the reliability of the baler is comprised due to repeated rotation and lifting motions of the turntable and lift boxes.

Instead of lowering and raising the turntable and the lift boxes during the compression cycle, it is also known to mount the lower platens on a tiltable turntable. In this construction, the turntable tilts like a sea-saw so that a lower platen beneath a lift box at the compression side of the baler rests upon a bottom sill for support during compression. The turntable is hooked to the lift boxes for rotation and is unhooked to allow the turntable to tilt during compression.

In addition, with the advent of higher production textile equipment and lines, it is desirable to provide fiber balers which are less complicated and more reliable, and provide higher production rates as well.

Accordingly, an object of the present invention is to provide a double lift box fiber baler which is improved and simplified in its mechanical construction to provide for increased reliability and bale production.

Another object of the invention is to provide an improved double lift box fiber baler in which complicated and power consuming lift assemblies needed to raise the turntables and/or lift boxes for rotation are eliminated.

Another object of the invention is to provide an improved double lift box fiber baler which is improved and simplified in its construction so that increased access to the mechanical parts for maintenance and repair may be had.

Another object of the present invention is to provide an improved double lift box fiber baler wherein the number of moving parts and mechanisms is minimized to enhance the reliability and production of the baler wherein individual, independently displaceable lower platens are provided which are alternately latched and unlatched from the lift boxes during the filling and compression cycles, respectively.

SUMMARY OF THE INVENTION

The above objectives are accomplished according to the present invention by providing a double lift box fiber baler which includes a frame, and first and second lift box assemblies. The first and second lift box assemblies are rotatably carried relative to the frame between a charging position and a compression position. Each of the lift box assemblies include a lift box, a vertically displaceable lower platen which forms a floor of the lift box, a displaceable mount for mounting the lower platen relative to the lift box, and a latch for integrally attaching the lower platen to the lift box. A tramper box assembly is disposed above the first lift box assembly at the charging position to receive fibers from a fiber supply source. A tramper foot assembly tramps fibers into the first lift box assembly at the charging position during a charging cycle to form a compacted fiber mass which contains a desired amount of fibers. A reciprocating main platen compresses a compacted fiber mass in the second lift box assembly to form a compressed fiber bale during a compression cycle. A bottom sill is disposed underneath the second lift box assembly at the compression position. A latch assembly is carried by each the lift box assembly which has a latched position by which the lower platen and lift box are integrally attached, and an unlatched position in which the lower platen may be displaced vertically to rest against the bottom sill for support during the compression of the fiber mass by the main platen during the compression cycle.

In a preferred embodiment, the latch assembly comprises a latch, a movable latching bar, and an actuator for moving the latching bar to engage the latch for latching and unlatching the lower platen and lift box. The latch assembly has a hook and a foot. The latching bar includes a first tang and a second tang. The actuator moves the latching bar so that the latching bar has a first position in which the foot is disposed between the first and second tangs in a non-contracting relation so that the latched lower platen and lift box may rotate relative to the frame. The latching bar has a second position in which the second tang engages the foot to move the hook to an unlatched position, and the latching bar has a third position in which the first tang engages the foot to move the hook to the latched position. A lift mechanism raises the lower platen to a latching position relative to the lift box so that the latch may be moved to the latched position. The lift mechanism comprises a hydraulic lifting cylinder. A spring assists in retaining the latch in a latched position. The latch comprises a first latch part carried by the lower platen and a second latch part carried by the lift box. The first and second latch parts engage to integrally attach the lower platen to the lift box in the latched position. Advantageously, a displaceable mount according to the invention comprises a spring mount which resiliently mounts the lower platen for vertical displacement relative to the lift box. The spring mount comprises a first part carried by the lower platen, a second part carried by the frame, a vertical post extending through the first and second parts, and a plurality of beveled washers carried by the vertical post which compress to allow the lower platen to be displaced downwardly.

A reversible ejector assembly is provided for ejecting a strapped bale from either side of the baler. The ejector assembly comprises an ejector plate, a pivot for pivotally attaching the ejector plate to the lower platen, and a moveable pivot amount which allows for the pivot to be attached into a first side position or a second side position so that the strapped bales may be ejected to a first side of baler when the pivot is mounted in the first side position and to a second side of the baler when the pivot is mounted in the second side position.

In a preferred form of the invention, a rotating standard is carried by the frame. The first and second lift boxes are carried by the standard. A connector flange is carried by the standard, the drive wheel includes a split drive sprocket having two sprocket halves affixed to the connector flange. A drive transmission comprises a drive chain connected to a hydraulic drive motor for rotating the boxes between the charging and compression positions.

Advantageously, a dog assembly, having a plurality of fiber retaining dogs, has a closed position for retaining the compacted fiber mass which has been tramped by the tramper foot assembly during charging. A dog assembly actuator moves the fiber retaining dogs to an open position which allows passage of the main platen during compression. The main platen comprises spaced vertically extending wings for engaging the dog assembly actuator in vertical reciprocating motions for maintaining the fiber retaining dogs in the open position. The dog actuator comprises a pair of laterally spaced fiber retaining dogs which are in alignment with the wings for engagement with the wings to maintain the dog assembly in the open position.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 5A is an enlarged front elevation with parts in section illustrating a displaceable lower platen and latch assembly in a first position wherein a displaceable lower platen is in a first position in which a latch assembly connects the lower platen and a lift box together for rotation;

DESCRIPTION OF A PREFERRED EMBODIMENT

Figure 3:
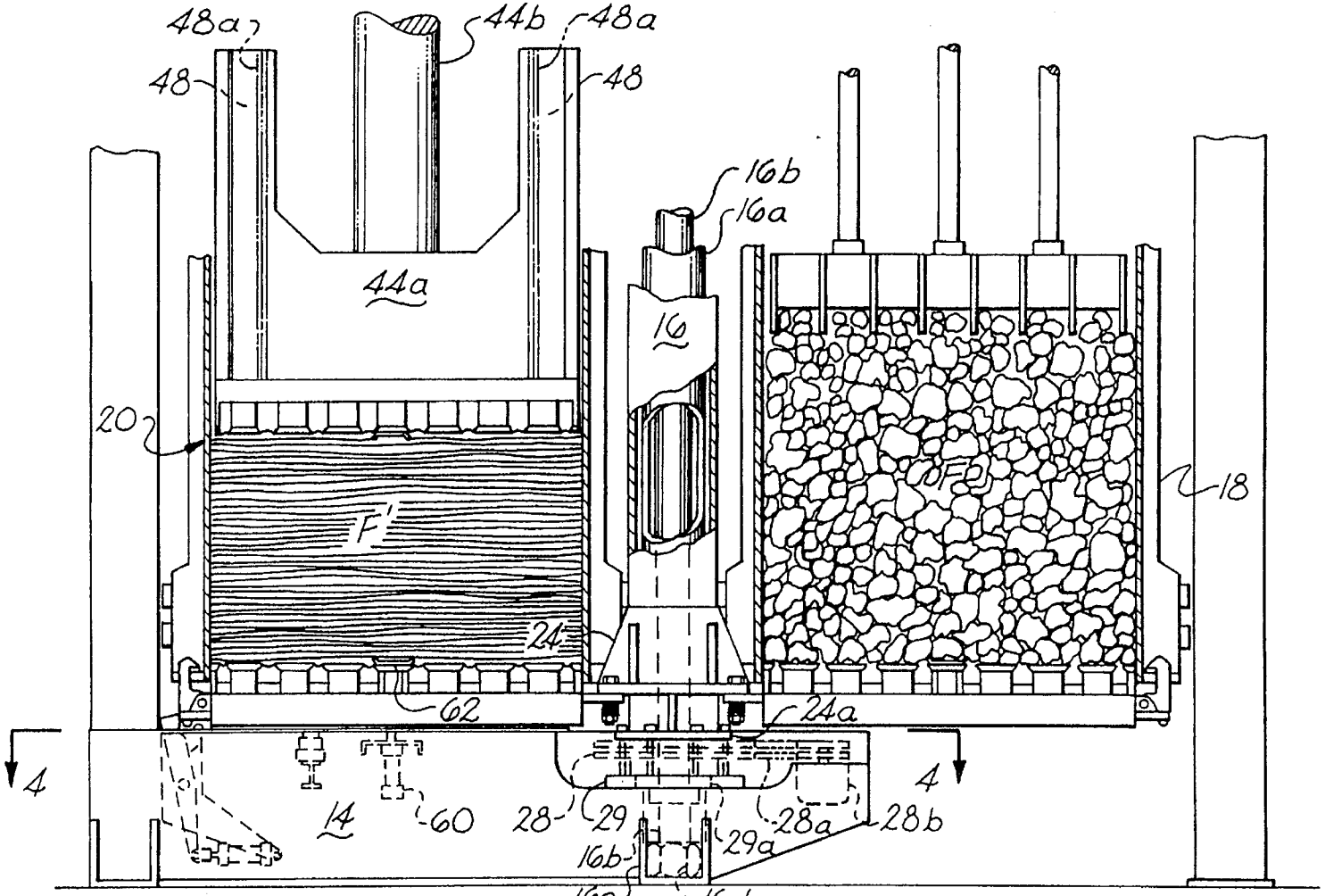
FIG. 3 is a front elevation with parts in section illustrating an improved double lift box baler constructed according to the present invention.

Referring now to the drawings, the invention will now be described in more detail. As can best be seen in FIG. 1, a high production, double lift box baler, designated generally as A, is illustrated. Baler A includes a baler frame assembly 10 having a base 10*a* which is mounted to a floor 12 in any suitable manner. The frame includes two spaced side frames 10*b* and a top sill or frame 10*c*. A bottom sill, designated generally as 14, is carried at the base of the frame. There is a first lift box assembly, designated generally as 18, and a second lift box assembly designated 20, which are identical. The first and second lift box assemblies are carried for rotation by a tubular spindle 16 having a square cross-section. Tubular spindle 16 rotates between bottom sill 14 and top frame member 10*c*. The box assemblies are affixed to tubular spindle 16 by means of an upper collar mount 22 affixed to ears 20*a*, 18*a*, of each lift box assembly, and a lower drive collar assembly, designated generally as 24 affixed to the spindle. In particular, it is noted that the lift box assemblies are attached to drive collar 24 by means of displaceable mount assemblies 26, which will be described in more detail at a later point. As can best be seen in FIG. 3, drive collar 24 includes a base flange 24*a* onto which is bolted a split drive sprocket 28. Drive collar 24 and drive sprocket 28 are also affixed to a mounting plate 29 which rotates about an inner bearing race 29*a* on sill 14. Drive sprocket 28 is driven by means of a drive chain 28*a* that is in turn driven by a hydraulic motor 28*b*. It is possible that other forms of drive wheels and drive belts may be utilized or a direct axial drive utilized. It is highly advantageous, however, that drive sprocket 28 is split so that it may be taken off of drive collar 24 for replacement. In this manner, tubular spindle 16 is rotated about fixed standard 16*a* which is fixed between sill 14 and top frame 10. A tie rod and spacer 16*b*, which pulls the sill and top frame together, has affixed in a channel 16*c* and an upper end fastened to the top frame by nuts 16*d*. By this means, the lift boxes are rotated between a fiber charging and tramping position (right) and a fiber compression position (left) where filling and compression takes place in lift box assemblies 18, 20, respectively (FIG. 3). Proximity switches (not shown) may be used to detect the positioning of the lift boxes.

Figure 2:
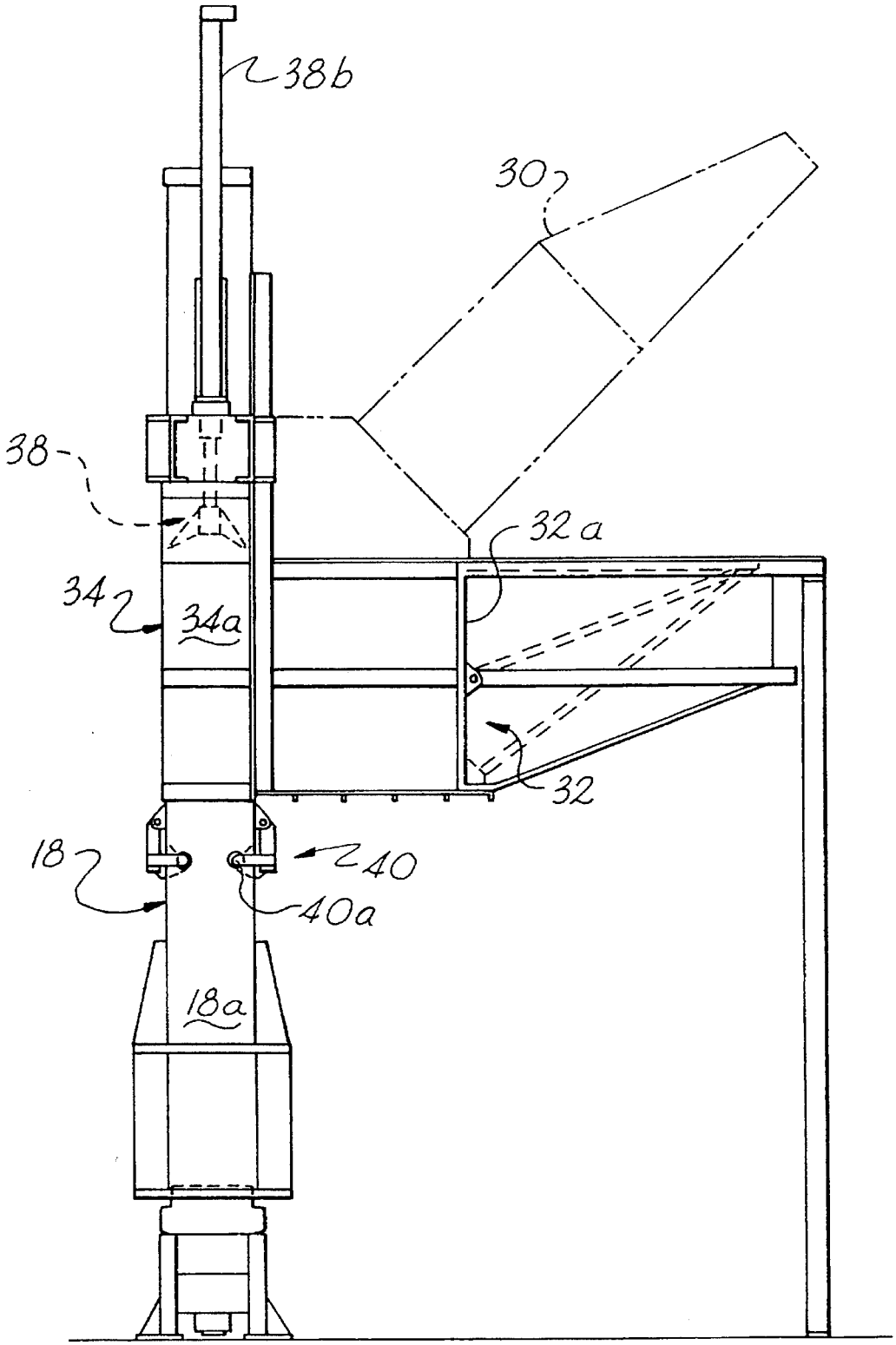
FIG. 2 is a side elevation of a double lift box baler constructed according to the invention wherein one of the lift boxes is being filled during a filling cycle.

Referring to the charging or filling cycle, as can best be seen in FIG. 2, fiber is fed from a suitable filling means 30 to a fiber pusher assembly 32 wherein a pusher plate 32*a* pushes the fibers into a tramper box assembly, designated generally as 34, having a tramper box 34*a*. When the tramper box is full, the fibers are tramped into lift box assembly 18 by means of a tramper foot assembly, designated generally as 38. Tramper foot assembly 38 comprises a plurality of spaced tramper feet 38*a* which tramp the fibers into lift box 18*a* in a conventional manner. In so doing, the tramper foot presses the fibers past a dog assembly, designated generally as 40, having a plurality of fiber retention dogs 40*a* which retain the fibers once they are pushed past the dog assembly. For this reason, tramper feet 38*a* are spaced to go between adjacent fiber retention dogs 40*a* so that the tramper feet pass freely past the dog assembly. The fiber retention dogs pivot outwardly to allow the mass of fibers to pass through the dog assembly on the downward tramping stroke, and close behind the tramper foot assembly as it retracts to retain the fiber mass in lift box 18*a*. In this manner, the lift box 18*a* is charged with fibers. The number of tramping cycles depends on the fiber density, the desired bale weight, and finished bale dimensions. Typically, a single, finished bale requires up to eighteen charges depending on the loose fiber density, required bale weight, and desired production rate. Tramper foot assembly 38 is extended and retracted by means of a tramper cylinder 38*b* and is guided by a tramper guide rod 38*c*. A tramper proximity assembly 38*d* acts as a guide rod and also provides proximity signals which may be furnished to a suitable control system for controlling the tramping operation. Once lift box 18*a* is filled, it is rotated to the position of lift box 20*a* for compression of the fiber mass which has been tramped in the previous tramping and filling cycle on the right side of the baler. It is noted that during the tramping cycle, lower platen 18*c* of lift box assembly 18 is latched to lift box 18*a* by means of latch hook 18*c* so that the tramping of fibers in lift box 18*a* occurs against lower platen 18*b* as affixed with lift box 18*a*.

Figure 1:
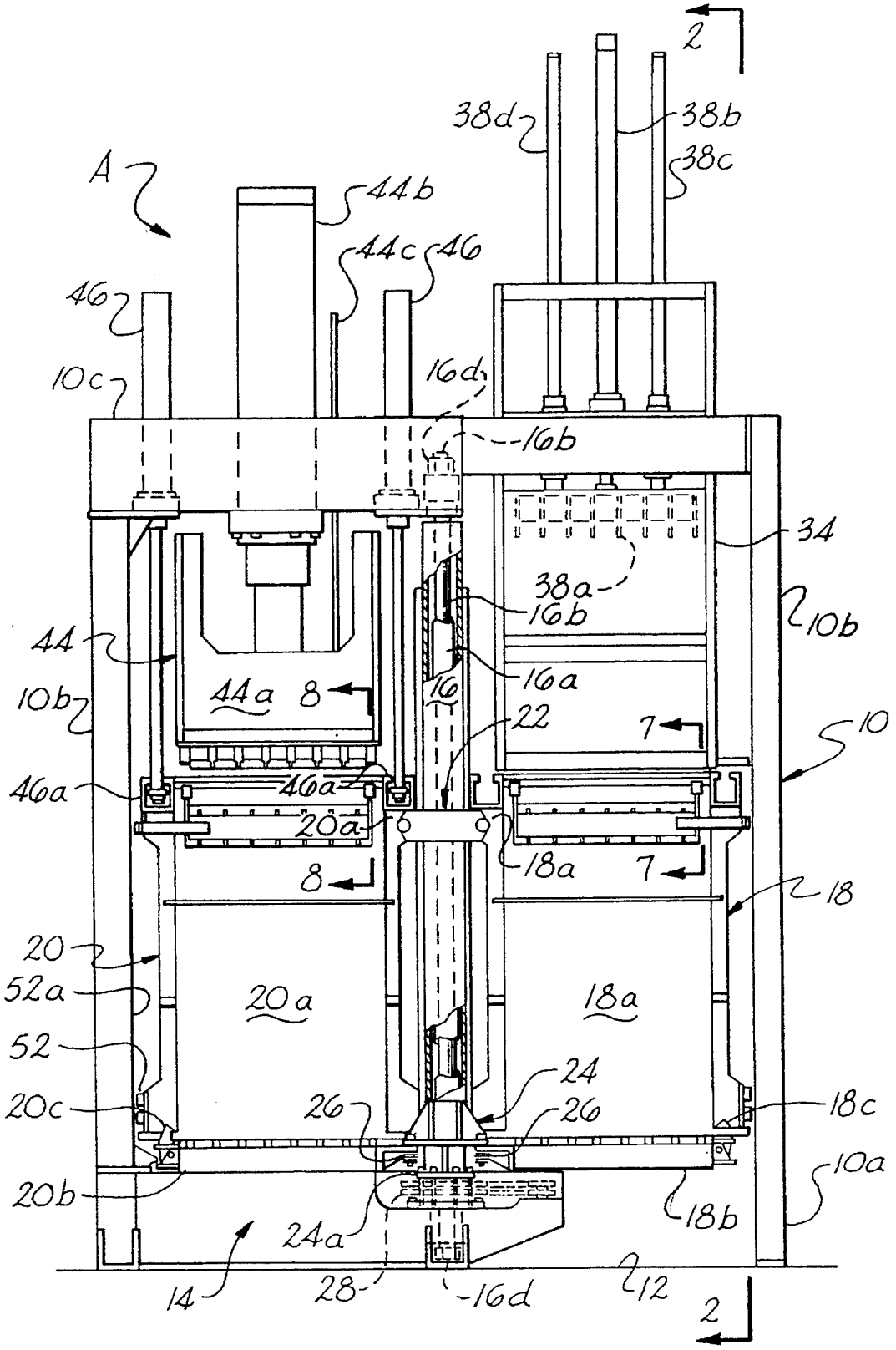
FIG. 1 is a front elevation of a double lift box baler constructed according to the present invention.
Figure 10:
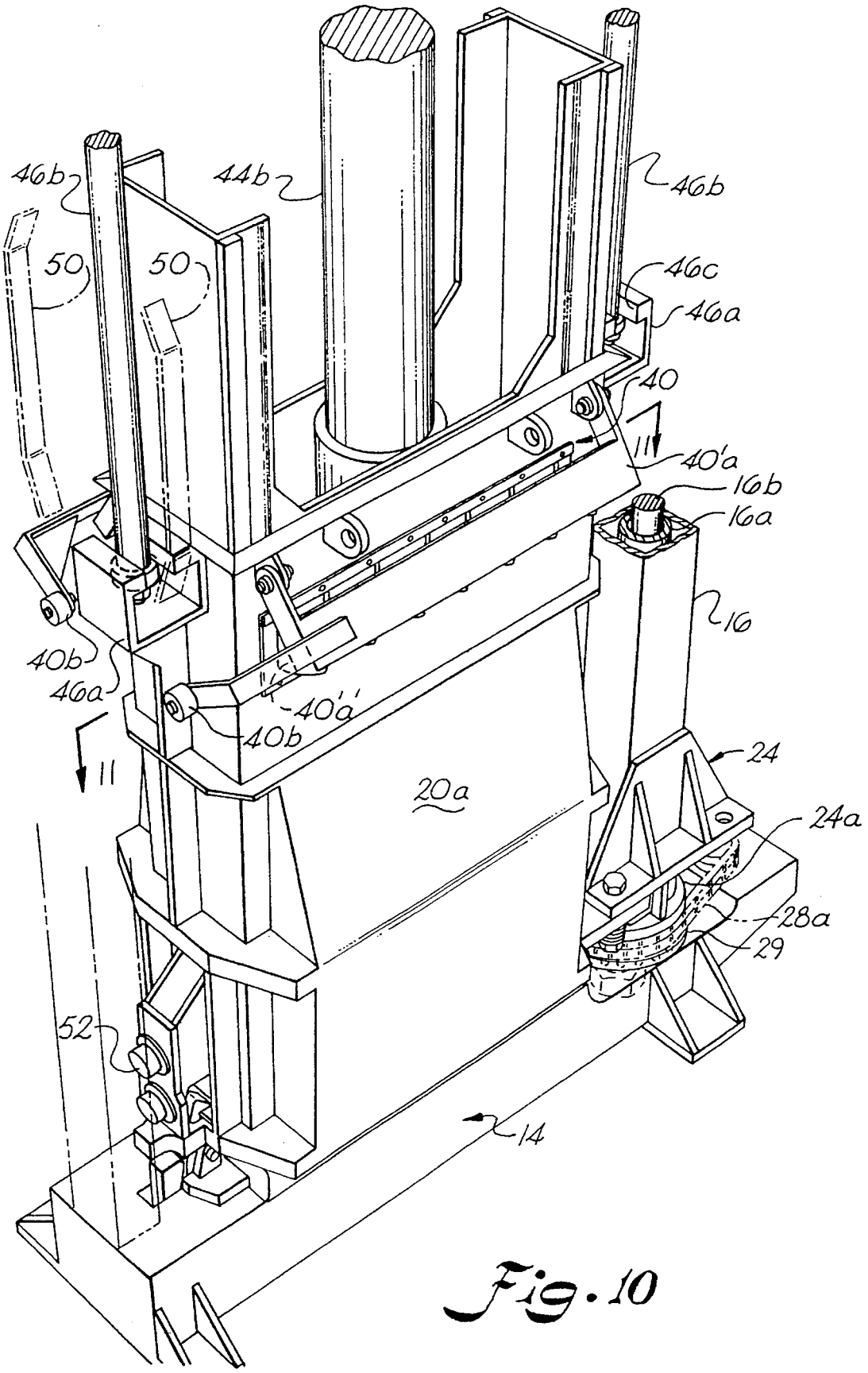
FIG. 10 is a perspective view of a lift box on the compression side of the baler during a compression cycle wherein a main compression platen of the baler is provided with a wing section for maintaining the fiber retention dogs in an open position during compression.
Figure 12:
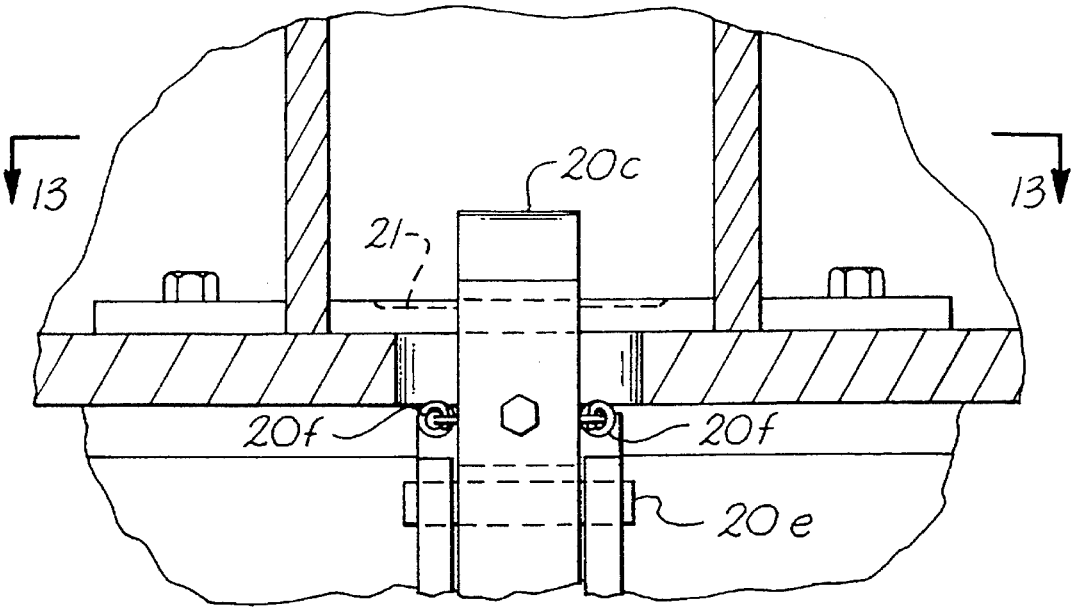
FIG. 12 is a sectional view taken along line 12—12 of FIG. 4.
Figure 13:
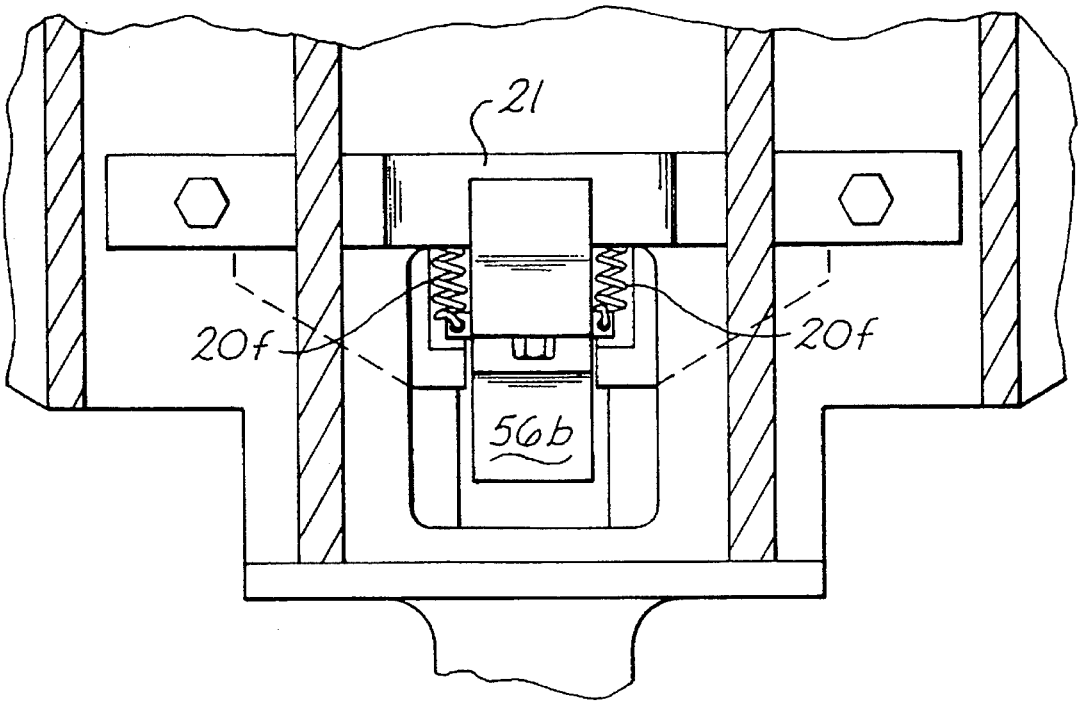
FIG. 13 is a sectional view taken along line 13—13 of FIG. 12.

Referring to the compression side of baler A, which is the left side, as illustrated in FIGS. 1 and 3, as well as the remaining figures in the drawings for sake of clarity, the structure and operation of the baler during the compression cycle will now be described. The description will be made with reference to lift box assembly 20 as though lift box 20*a* has been charged on a previous cycle with a full amount of tramped fibers ready for compression and baling. There is a main platen assembly, designated generally as 44 which includes a main platen 44*a* which is reciprocated by a main ram cylinder 44*b*. Main platen assembly 44 also includes a proximity mount assembly 44*c* which generates positions indicating the position of main platen 44*a* for use by a suitable control system. There are a pair of lift box cylinders 46 on either side of the main ram cylinder which engage in lift brackets 46*a* carried by each lift box for lifting the lift boxes at the appropriate moment during the compression cycle. As can best be seen in FIGS. 1 and 10, the lift rods of the lift box cylinders are extended and are engaged in the lift brackets. It will be noted that lift brackets 46*a* include slots 46*c* which receive lift rods 46*b* and that the slots are open on both ends so that the lift rods may enter the lift boxes from either side of the lift brackets. In this manner, lift boxes may be rotated either one hundred eighty degrees between the fill and compression positions or may be rotated three hundred sixty degrees between the fill and compression positions. As can best be seen in FIG. 3, main platen 44*a* includes vertical wing sections 48 along which a path 48*a* is defined that engages the outermost fiber retention dogs 40*a'* to move and hold the fiber retention dogs in an outwardly rotated position to enable main platen 44*a* to pass through the dog assembly 40. For this purpose, the outside dogs 40*a'* are constructed from a wear resistant material such as A514 steel. Once the main platen compresses the tramped fiber mass to a predetermined strap height, the lift box will be lifted vertically, and completely removed from the compressed bale of fibers. During the upward lifting of lift box 20*a*, outer cam rollers 40*b* of dog assembly 40 will engage angle arms 50 carried by the baler frame to maintain the dog assembly in its open position (FIG. 10). This is to enable main platen 44*a* to retract through the dog assembly after the bale is strapped and removed from lower platen 20*a*. As lift box 20*a* is raised and lowered, it is guided by cam rollers 52 and cam track 52*a* (FIG. 1).

Figure 5B:
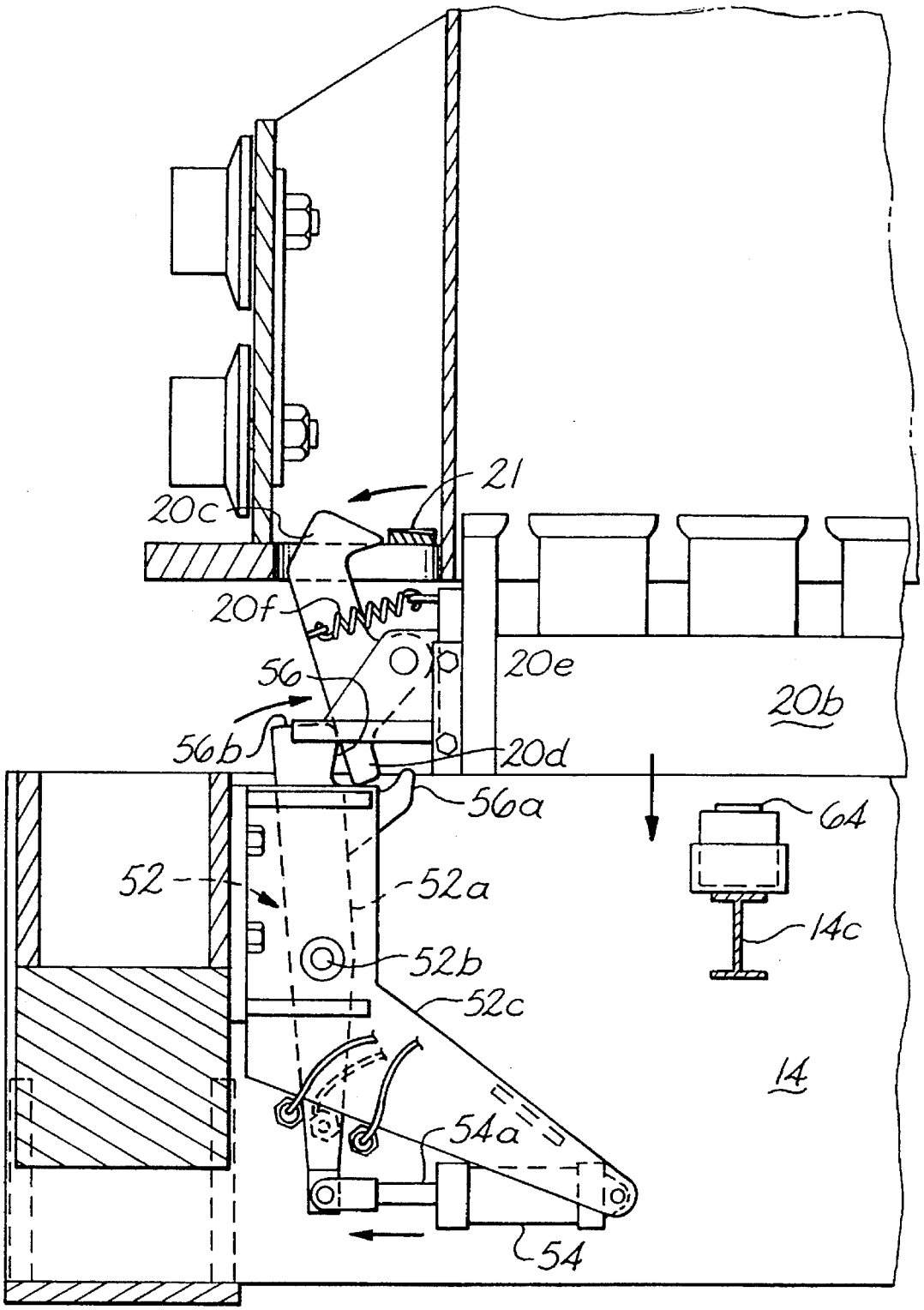
FIG. 5B is a front elevation with parts in section illustrating a lower platen mounted for displacement and a latch assembly in a second position so that the displaceable platen rests upon a fixed sill during a compression cycle.

Referring now in more detail to the compression cycle, FIGS. 5A and 5B will be referred to describe the detachment of lower platen 20*b* from lift box 20*a* during compression. As can best be seen in FIG. 5A, latch hook 20*c* is latched onto a latch element 21 which is an integral part of lift box 20*a*. In this position, lower platen 20*b* is integral with the lift box, as the opposing end of lower platen 20*b* is affixed to drive collar 24 by means of displacement mount 26. Displacement mount 26 includes a spring mount of lower platen 20*b* which allows lower platen 20*b* to be displaced downward when latch hook 20*c* is released. In the illustrated embodiment, the spring mount comprises a plurality of three inch Bellville spring washers 26*a* stacked upon one another and held in place by means of a bolt 26*b* and nut 26*c*. In this manner, a flange 20*e* affixed to lower platen 20*b* is allowed to ride over bolt 26*b* and be displaced upwardly and downwardly under the force of the spring washers. There is a latching assembly, designated generally as 52, carried partially within bottom sill 14 for actuating latch hook 20*c* (and 18*c*) in the compression position (FIGS. 5A and 5B). Latch assembly 52 includes a latching bar 52*a* which pivots about a pivot 52*b* carried on a latch mounting bracket 52*c*. Latch mounting bracket 52*c* is attached to bottom sill 14 by means of bolts. A lower end of latching bar 52*a* is connected to a piston rod 54*a* of a two-way hydraulic cylinder 54 which actuates latching bar 52*a*. Hydraulic cylinder 54 is mounted to a remote end of latch mounting bracket 52*c*. An upper end of latching bar 52*a* includes an actuating fork 56 which includes a first tang 56*a* and a second tang 56*b* for engaging a lower end 20*d* of latch hook 20*c*. Latch hook 20*c* pivots about a pivot 20*e* carried on lower platen 20*d* and a spring 20*f* assists in holding the latch hook in the latch position shown in FIG. 5A. Referring again to latch assembly 52, it will be seen that latching bar 52*a* has three positions. There is a first, center position, in which neither tang 56*a* or 56*b* engage hook foot 20*d* so that rotation of the lift boxes in and out of the latching assembly may occur. There is a second, extended position of piston rod 54*a* for unlatching hook 20*c*. There is a third, retracted position of piston rod 54*a* for latching latching hook 20*c*. Proximity switches may be utilized for detecting the position of latching bar 52*c* in these three positions to control hydraulic actuator 54. The positions and latching/unlatching operations will be described in more detail during the description the operation of the invention. It is sufficient at this point to say that when lift box 20*a* is rotated into the compression position, hook 20*c* is unlatched and lower platen 20*b* is allowed to rest and be supported by the upper surface of bottom sill 14, as can best be seen in FIG. 5B. With lower platen 20*b* unlatched, bottom sill 14 supports the platen during compression of the fibers into a compressed fiber bale. While the tamping of fibers at the filling position produces relatively small forces on the platen, the forces on the platen during compression are substantial.

Figure 4:
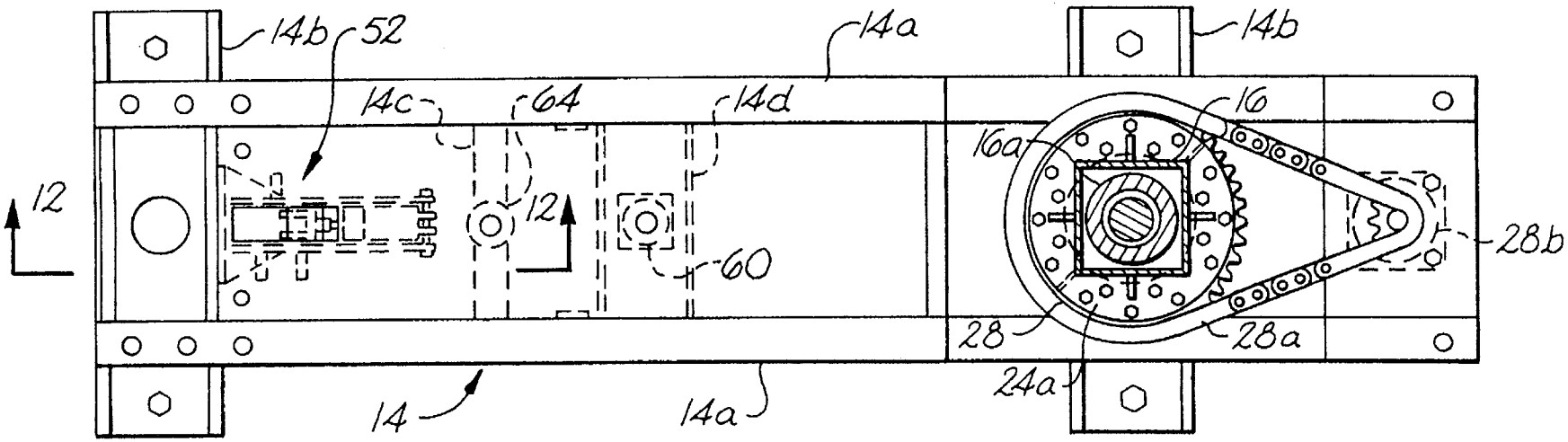
FIG. 4 is a sectional view taken along line 4—4 of FIG. 3.
Figure 54:
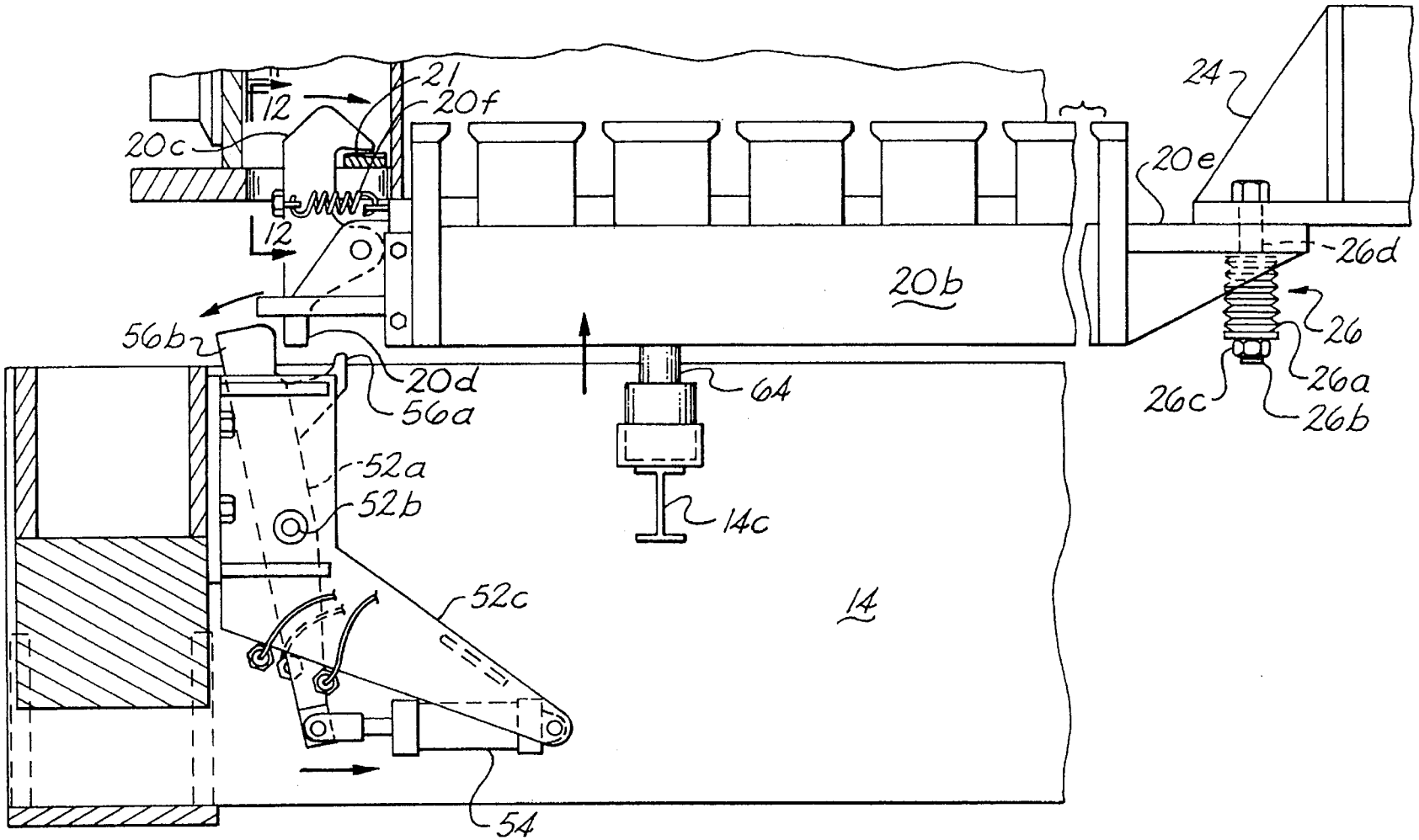
Figure 6:
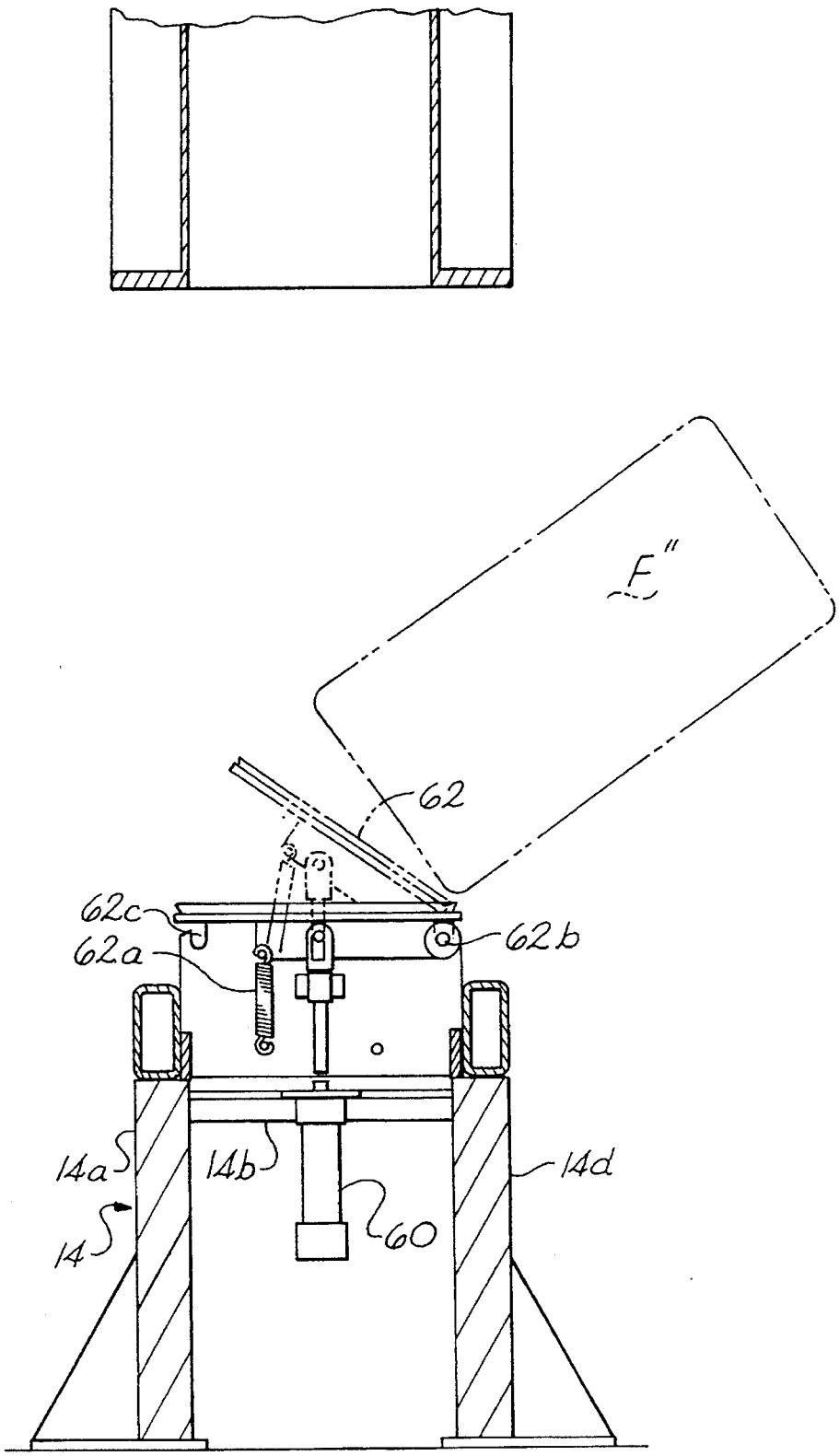
FIG. 6 is an end view with parts in section illustrating the ejection of a finished bale of fibers from the baler.
Figure 7:
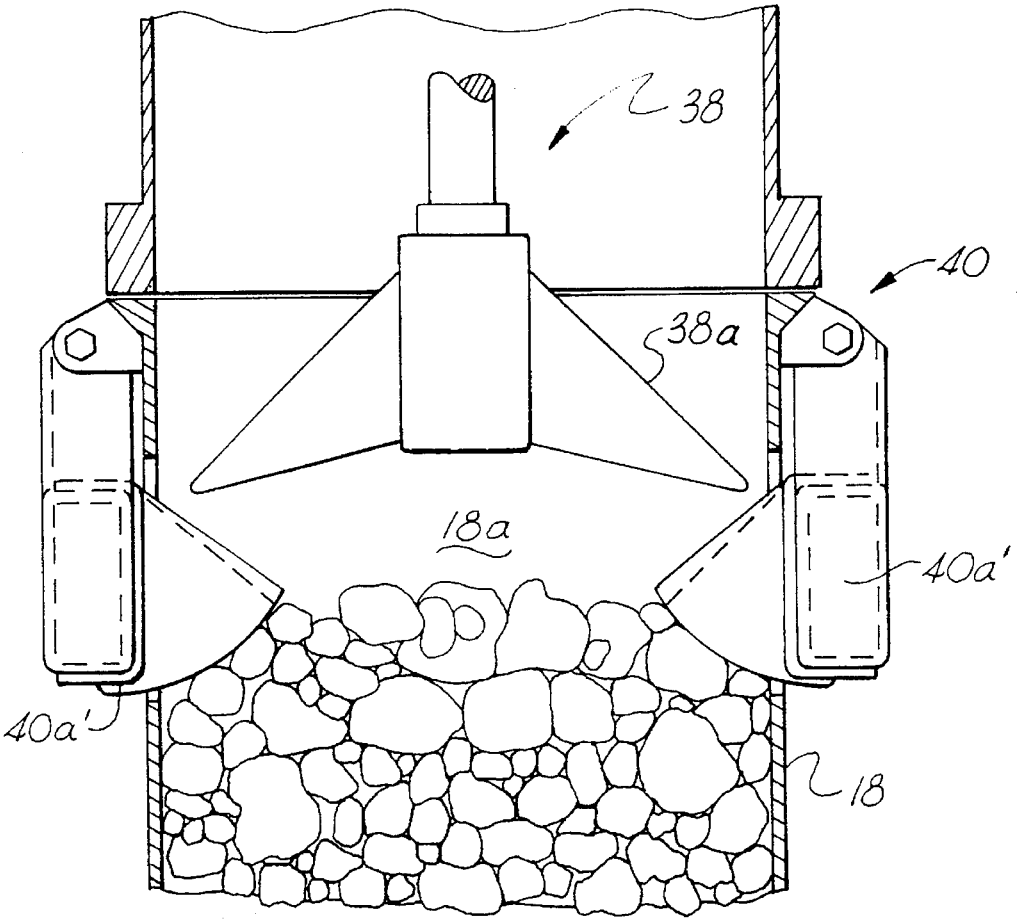
FIG. 7 is a sectional view taken along line 7—7 of FIG. 1 illustrating a tramping platen and fiber retaining dogs in a lift box during a tramping cycle.
Figure 11:
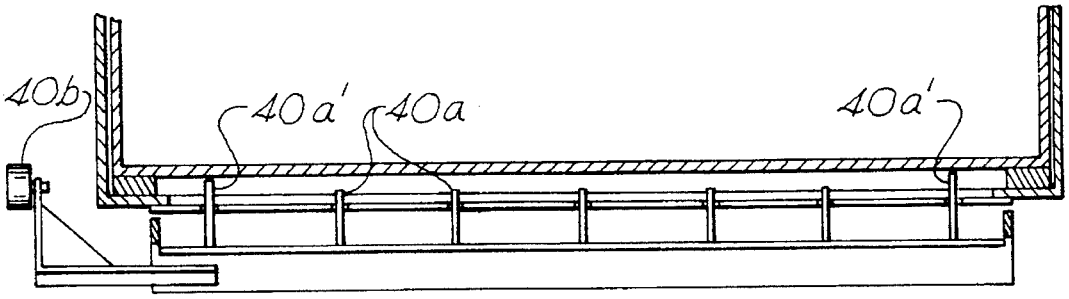
FIG. 11 is a sectional view taken along lines 11—11 of FIG. 10.
Figure 8:
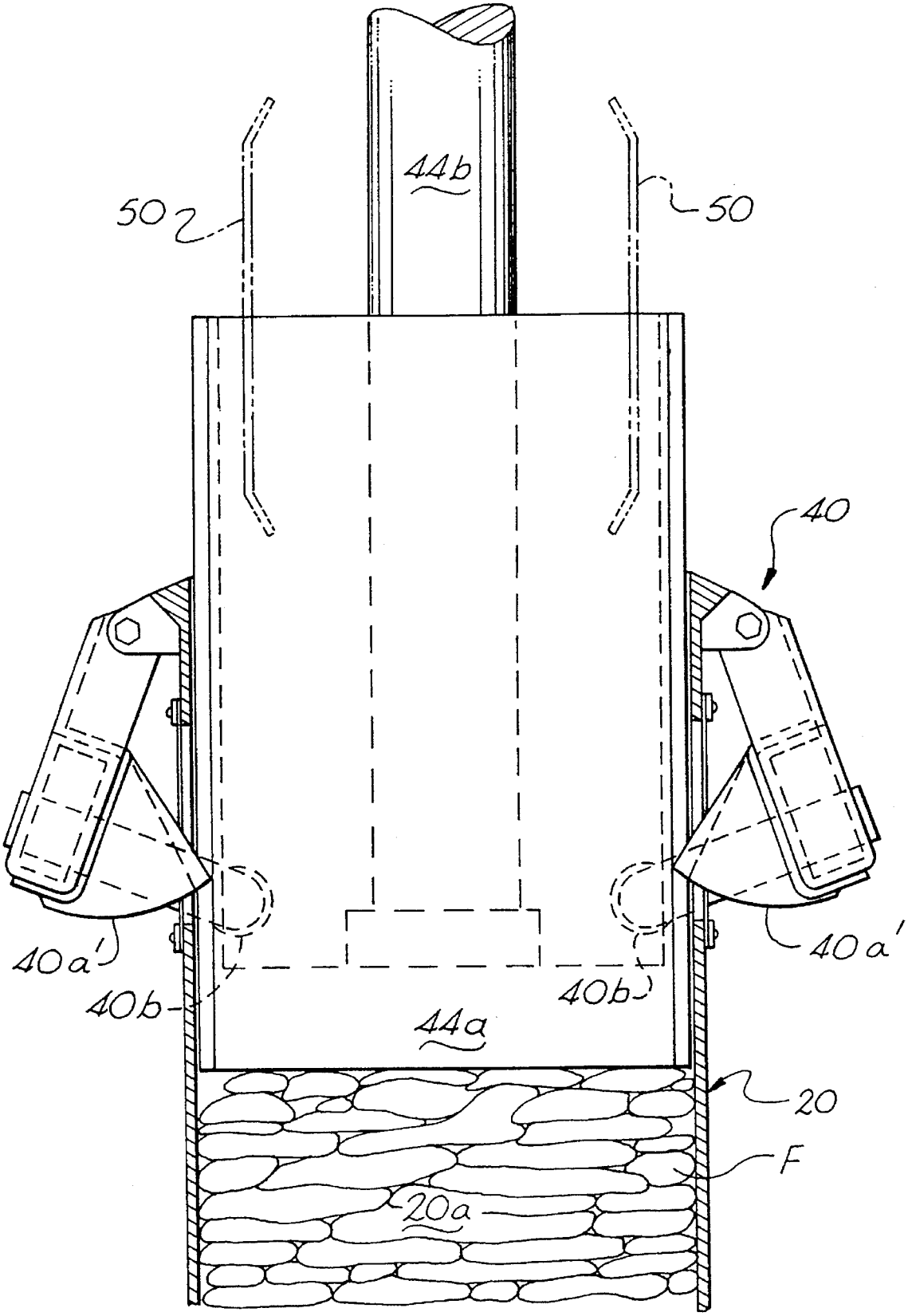
FIG. 8 is a sectional view taken along line 8—8 of FIG. 1 illustrating a main platen compressing fibers during a compressing cycle.

As can best be seen in FIG. 4, bottom sill 14 extends across only a part of the width of baler A, and includes a pair of spaced plates 14*a* bolted to the floor by plates 14*b*, and secured by certain cross braces. There is a cross brace 14*c* which affixes to lift cylinder 60. There is an ejector assembly which includes a hydraulic ejector cylinder 60, carried by a cross brace 14*d* and an ejector plate 62 which forms part of the lower platen and ejects the bale either to the left or right when the bale has been strapped after compression, and both the main platen and the lift box are raised. As can best be seen in FIG. 6, ejector plate 62 is returned under the force of a spring 62*a*. It will also be noted that simply by removing a bolt 62*b*, and mounting the bolt (at 62*c*) and spring on the opposite side of the ejector plate, the ejector plate may be caused to pivot to the left to eject a bale of fibers to the left instead of to the right. After compression of the fibers, a spring-return hydraulic cylinder 64 carried by bottom sill 14 raises lower platen 20*b* so that hook 20*c* may again be latched to lift box 20 for rotation to the ceiling position.

The open construction of bottom sill 14 provides convenient access to the various actuating cylinders, and the rotational drive of the lift box assemblies.

Figure 9A:
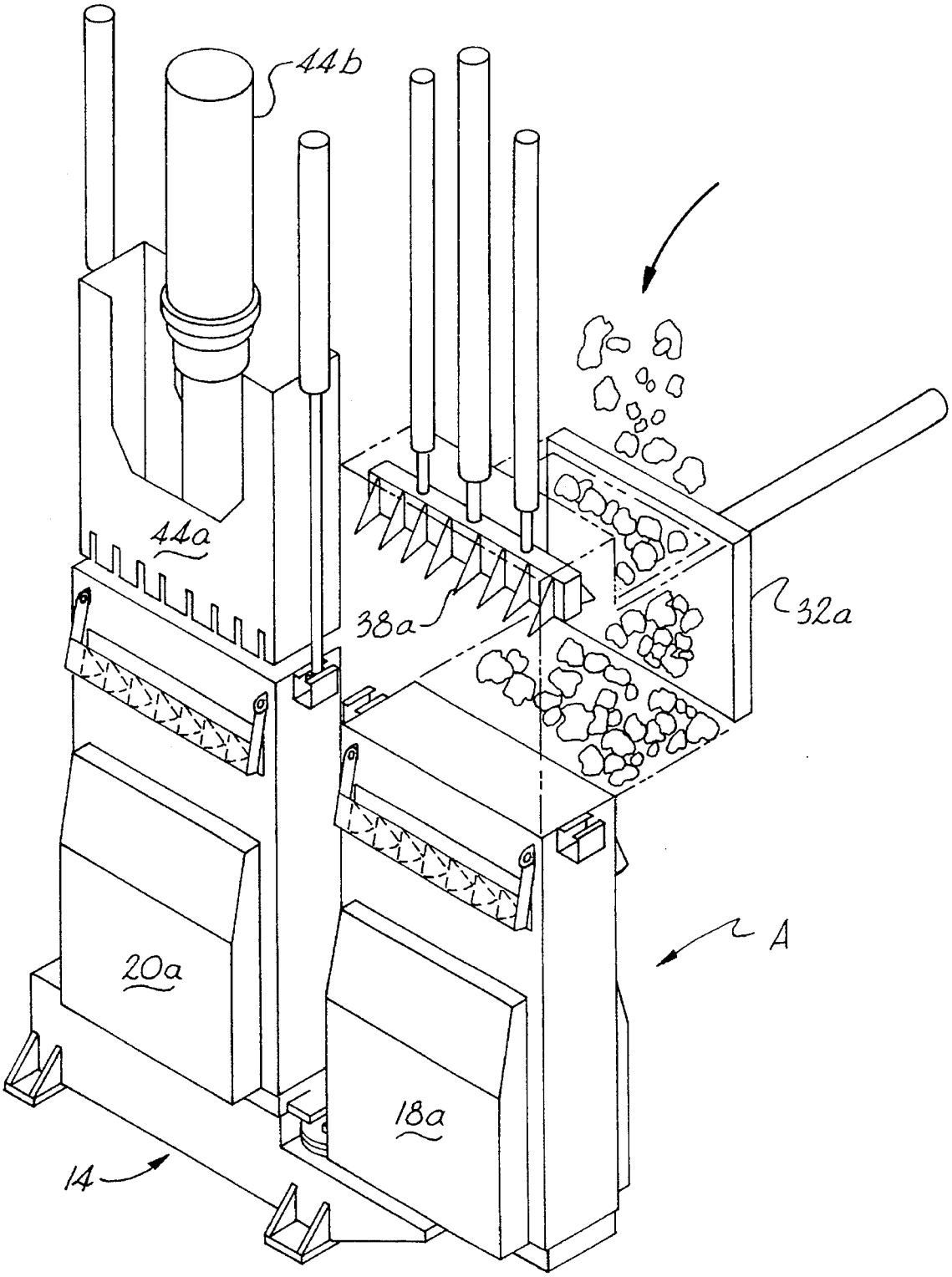
FIGS. 9A–9G are perspective views illustrating various stages of tramping and compression cycles in a double lift box baler according to the invention.
Figure 9B:
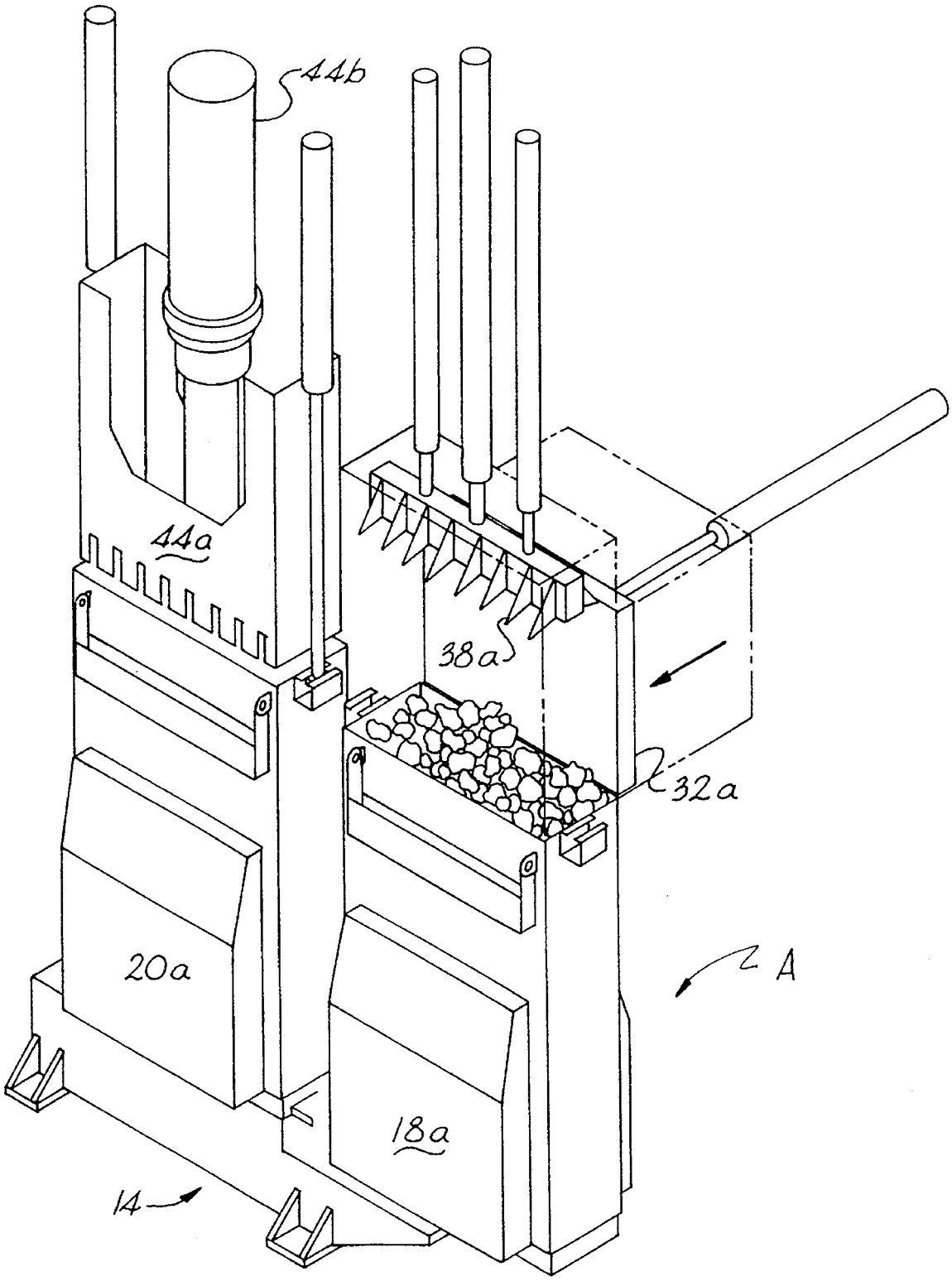
Figure 9C:
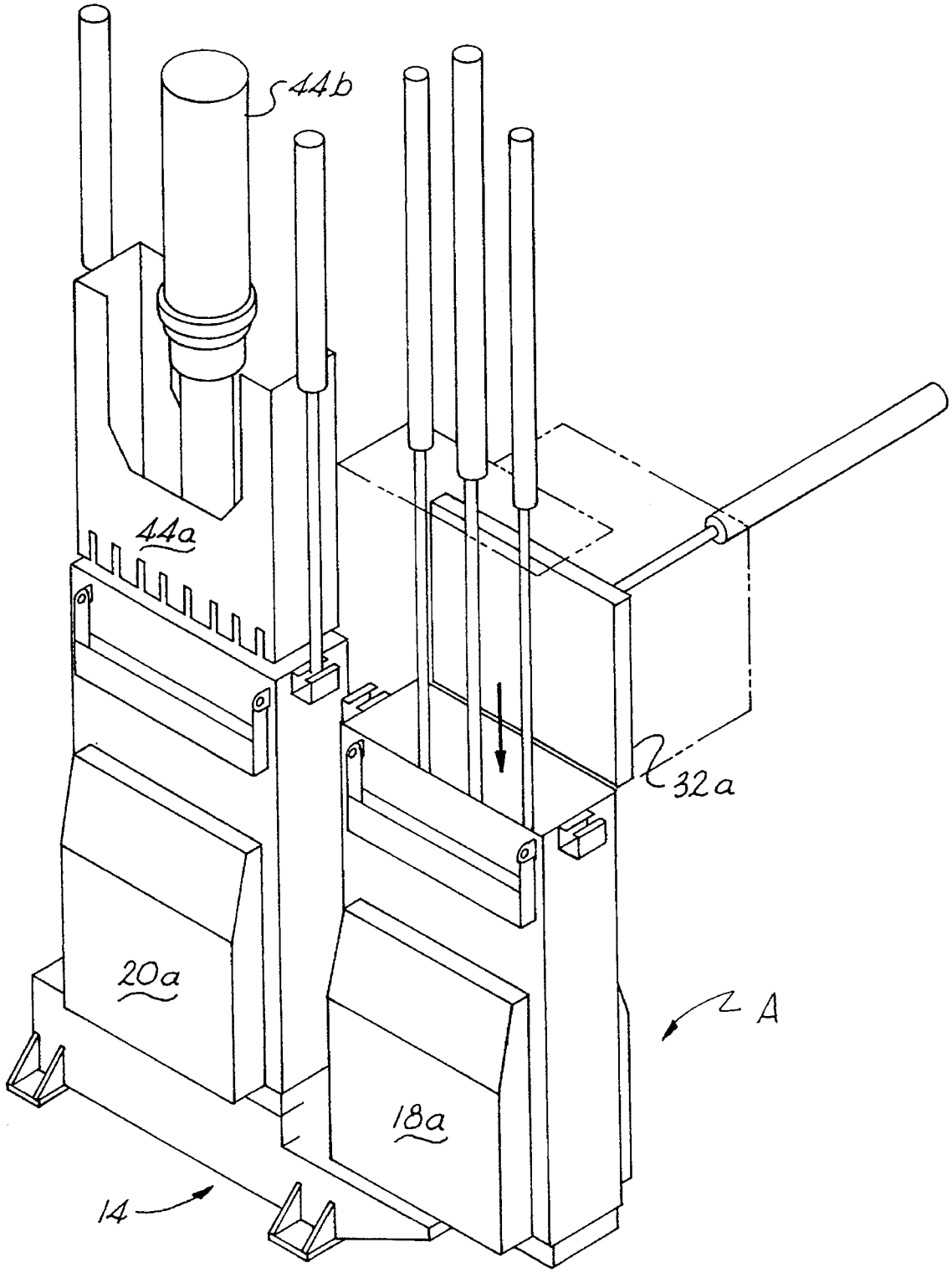
Figure 9D:
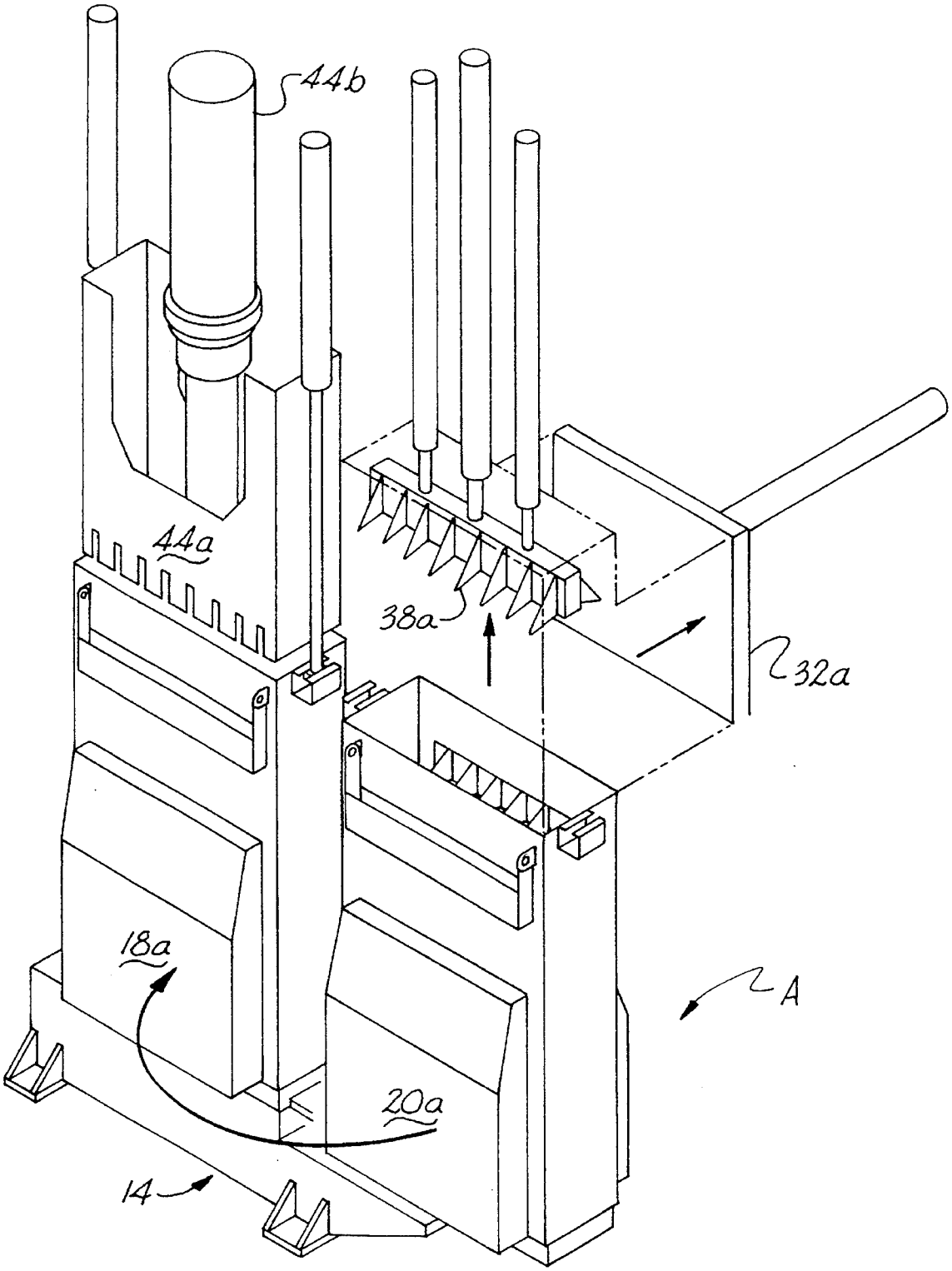
Figure 9E:
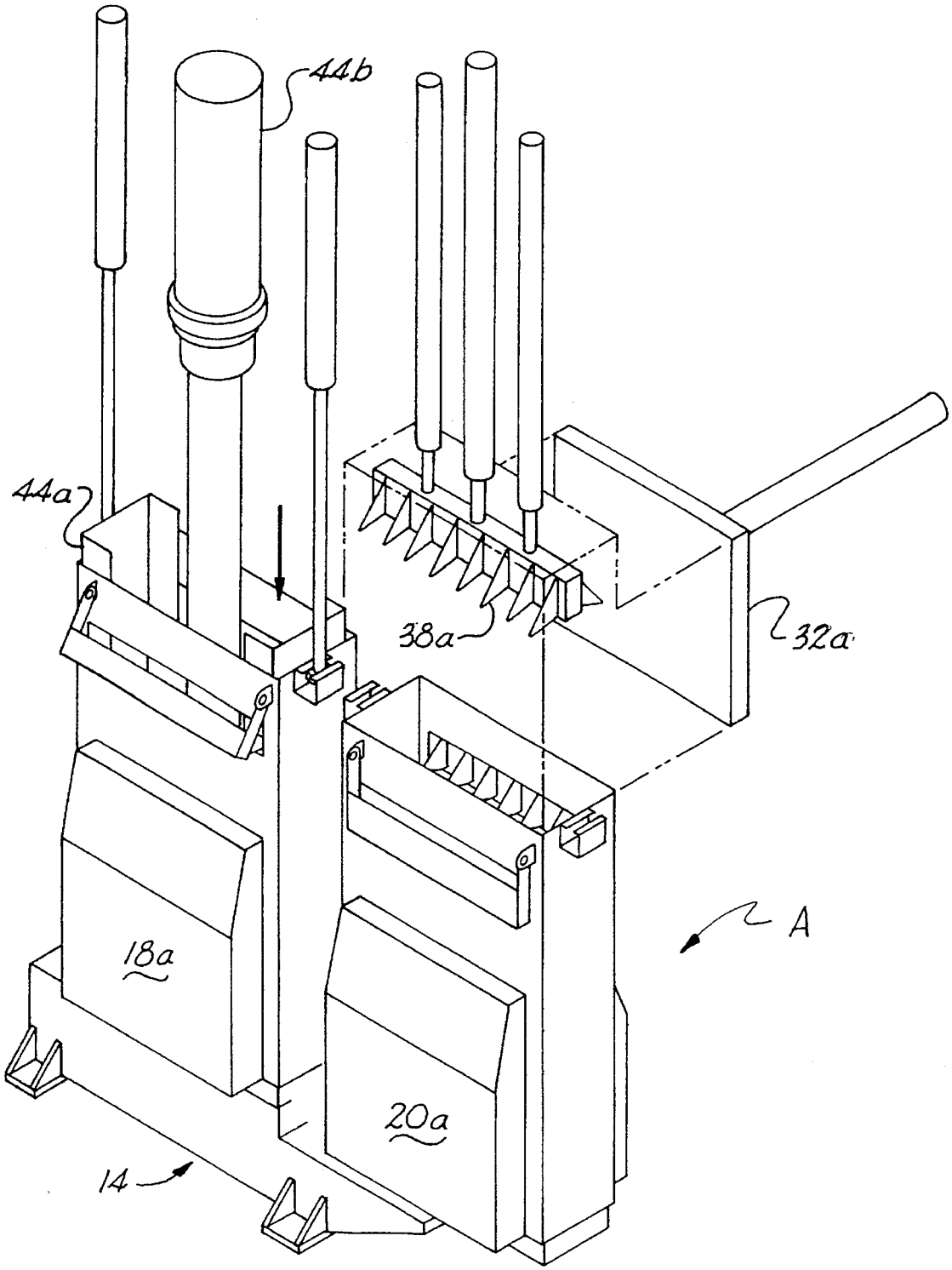
Figure 9F:
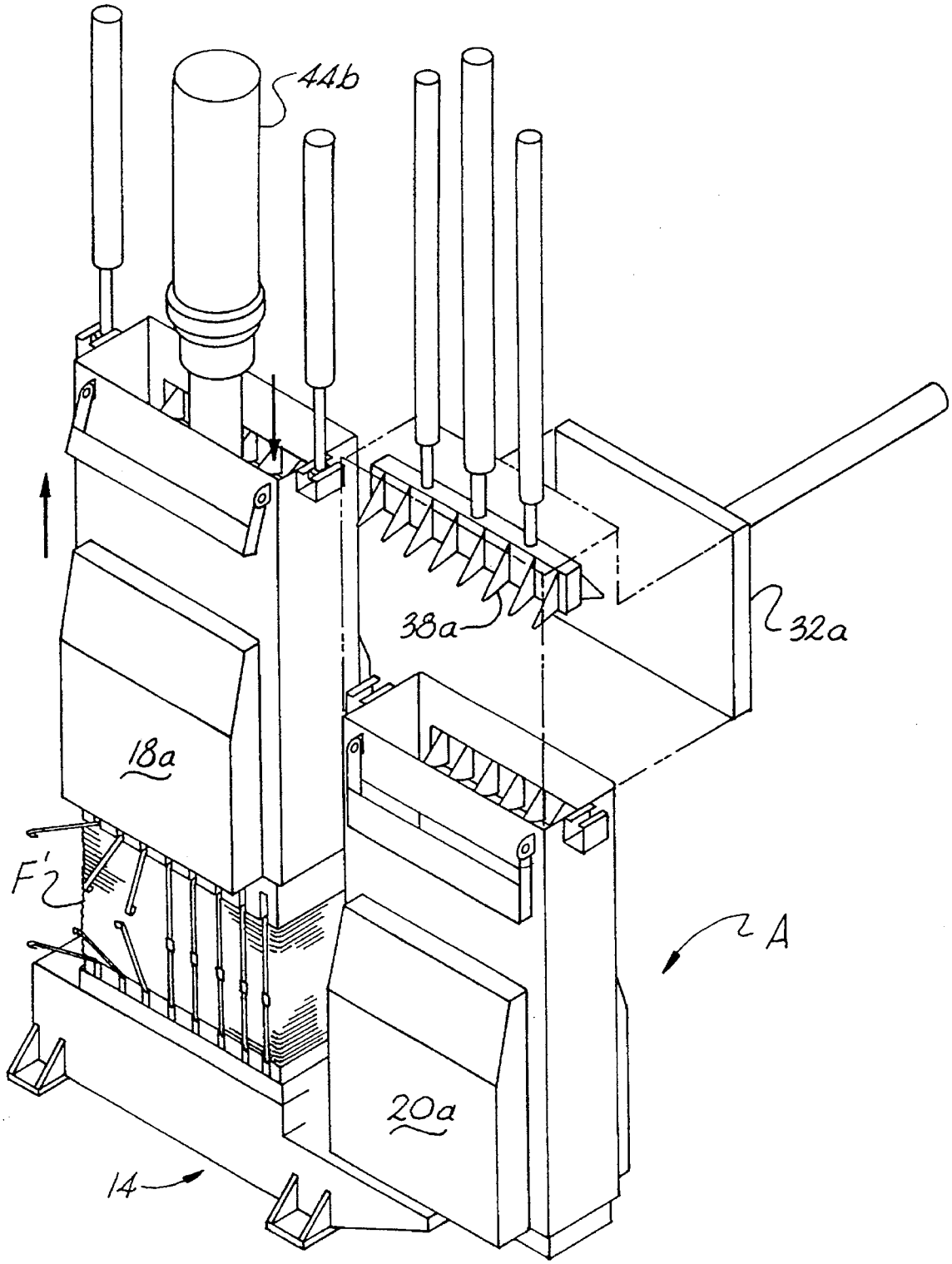
Figure 9G:
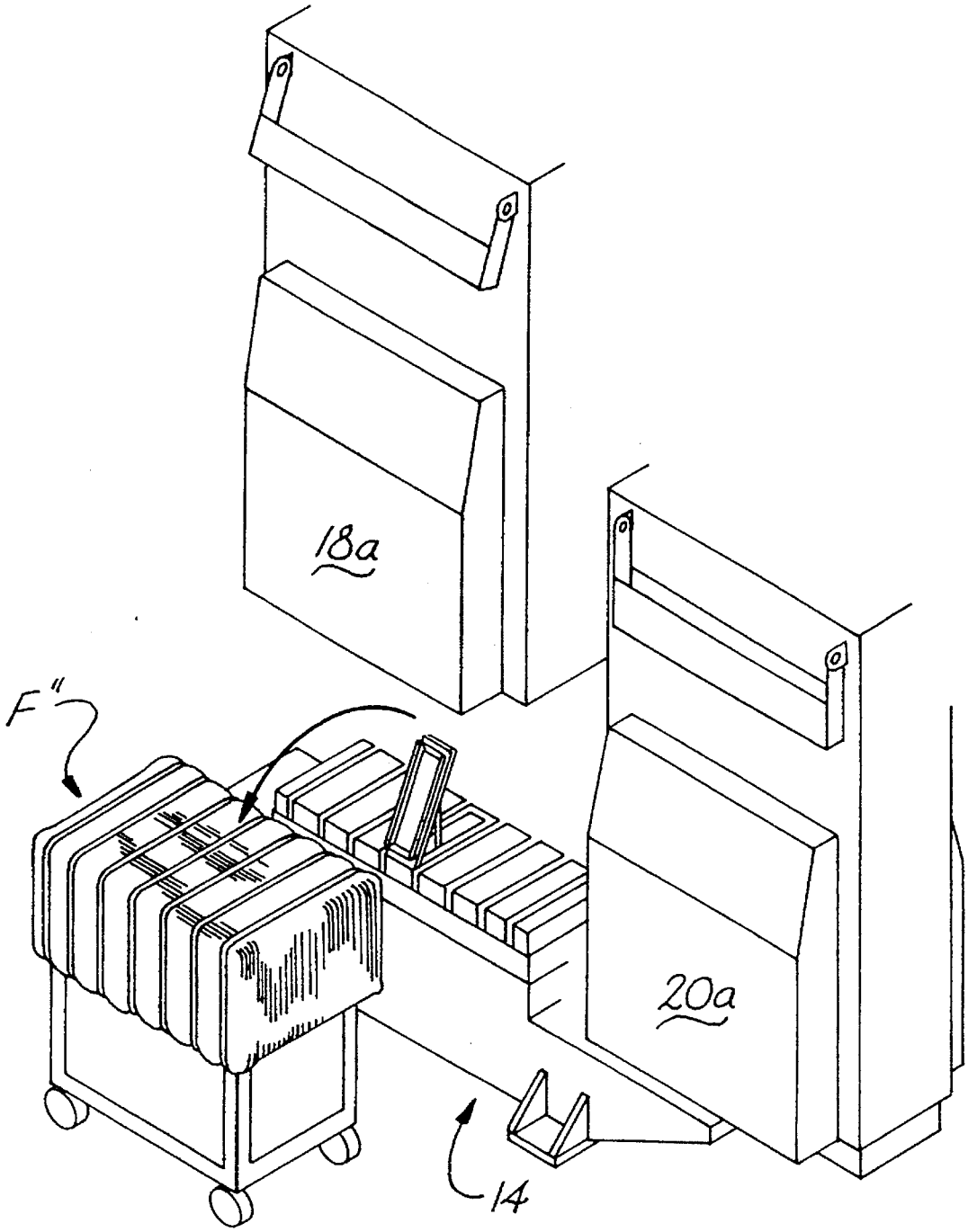

Charging and compression cycles will now be described in reference to FIGS. 9A through 9G of the invention. FIG. 9A illustrates first lift box assembly 18*a* in a charging position and second lift box assembly 20*a* in a compression position. Tramper foot 38*a* is in a raised position, and a load of fibers is being dumped into fiber pusher assembly 32. Pusher plate 32*a* is extended to push the fibers into tramper box assembly 34 (FIG. 9B). Tramper foot 38*a* is then extended to tramp the load of fibers into lift box assembly 18*a* (FIG. 9C). Once the loading and tramping of fibers has been repeated a sufficient number of times, the desired amount of fibers are tramped into lift box assembly 18A and the charging cycle is terminated. The lift box assemblies are then rotated (FIG. 9D). The compression cycle then begins in lift box assembly 18*a* with lift box assembly 20*a* now being empty allowing a charging cycle to begin in lift box assembly 20*a* (FIG. 9E). In the compression cycle, main ram platen 44 is extended to compress the fibers in the lift box assembly (FIG. 9E). Next, lift box 18 of lift box assembly 18*a* is raised so that straps may be placed around the compressed fiber bale F' (FIG. 9F). In order to place the straps about the compressed fiber bale, main platen 44 is extended an additional amount. After the straps are placed and fastened, the main platen is retracted allowing the bale to bloom. Finally, strapped bale F" is ejected off of the lower platen to either side of the baler (FIG. 9G).

Operation

The operation of the baler during compression will now be described in more detail referring to lift box assembly 20, and FIGS. 5A and 5B. Lift box 20*a* of lift box assembly 20 will be filled in a conventional manner by tramping a desired number of charges of loose fibers into the tramper box assembly 34, as described previously to provide a compacted fiber mass F of fibers. Lift box assembly 20 and compacted fiber mass are then rotated to the compression position (left position) where lift brackets 46*a* receive lift rods 46*b* of lift box cylinders 46. The lift box is raised three inches after latching is complete, and then the main ram extends. At this time, lower platen 20*b* will be unlatched from lift box 20*a*, as described previously. This allows lower platen 20*b* to rest on bottom sill 14 for support during compression. To unlatch hook 20*c* and lower platen, piston rod 54*a* is extended (FIG. 5B) so that upper tang 56*b* of latching bar 52*a* engages foot 20*d* of hook 20*c* and pivots hook 20*c* counter-clockwise to clear latching element 21. At this time, lift box 28 is lifted approximately three inches and main platen 44*a* extends into lift box 20*a*. Outside fiber retaining dogs 40'*a* engage wings 48 of main platen 44*a* so that all of the fiber retaining dogs are moved to the open position (FIG. 10). This allows main platen 44*a* to pass through dog assembly 40. Once main platen 44*a* has compressed the fibers to a height of approximately thirty inches, lift box 20*a* is raised vertically to completely be removed from the compressed block of fibers. The block of fibers is then compressed to a height of approximately seventeen inches. The compressed bale is then manually strapped by passing straps through strap openings 49 in a conventional manner. Alternately, an automatic strapping device may be utilized to strap the bales. Once the bale is strapped, the bale is released, and main platen 44 will be retracted, allowing the compressed bale to bloom or extend naturally to provide a strapped fiber bale. Ejector plate 62, which forms a part of lower platen 20*c*, will then be actuated by cylinder 60 to eject the bale off of the lower platen. After the bale has been ejected, main platen 44*a* will be travelling in its upward mode to its full retracted position. At the same time, lift box 20*a*, which has been previously raised, will be lowered and will move relative to main platen 44*a* which is being raised. In order for main platen 44*a* to clear dog assembly 40, cam rollers 40*b* of the dog assembly will be engaged by angle bars 50 to assure that the fiber retention dogs are in their open position to allow passage of the main platen. Once lift box 20*a* is lowered to its full down position, jack cylinder 64 is actuated to raise lower platen 20*a* off of bottom sill 14 to allow for reattachment of lower platen 20*b* to lift box 20*a*. At this position, latching bar 52*a* will be moved by hydraulic cylinder 54 to its third position wherein tang 56*a* will engage foot 20*d* to pivot hook 20*c* clock-wise and engage latched element 20*d*, as can best be seen in FIG. 5A. After latching, latching bar 52*a* is moved to its first position where tang 56*a*, 56*b* are centered relative to foot 20*d*. In this position, lift box 20*a* and lower platen 20*b*, integrally attached, are rotated to the filling position. Spring 20*f* assists in maintaining hook 20*c* latched with element 20*d*. Again, because of the open ended design of latching bracket 46, lifting box 20*a* may be rotated in either direction, i.e. one hundred eighty degrees, or a full three hundred sixty degrees circle, depending on the customer's design and preference.

Thus, it can be seen that the mechanical construction required for vertical lowering and raising of the lower platen for compression and rotation of the lift boxes is substantially reduced and simplified providing increased reliability and higher production rates. No longer is it necessary to lift both platens or lift boxes at the same time, or the whole center column, which has been done in prior art arrangements. Accessibility to the mechanical drive components of the baler is improved for repair and replacement of parts since it is necessary to extend bottom sill 14 only underneath the compression station and central drive area leaving the area underneath the charging station open for access to the drive components. Likewise, the interior portion of bottom sill 14 is readily accessible for repair and replacement of parts. By providing individual lower platens carried individually and independently on lift boxes, it is necessary to raise and lower only one platen during compression. Only a small lifting cylinder is needed to lift the platen after the compressed bale has been ejected. The lower platen is empty, and it is only necessary to raise the empty platen for reattachment to the lift box. Thus, it is necessary only to lift approximately three thousand pounds rather than approximately ten thousand pounds as has been necessary in the prior art.

While a preferred embodiment of the invention has been described using specific terms, such description is for illustrative purposes only, and it is to be understood that changes and variations may be made without departing from the spirit or scope of the following claims.

What is claimed is:

1. A double lift box fiber baler comprising:

a frame;

a first lift box assembly rotatably carried relative to said frame between a charging position and a compression position;

a second lift box assembly rotatably carried relative to said frame between a charging position and a compression position;

each of said first and second lift box assemblies including a lift box, a vertically displaceable lower platen forming a floor of said lift box, a displaceable mount for mounting said lower platen relative to said lift box, and a latch for integrally attaching said lower platen to said lift box;

a tramper box assembly disposed above said first lift box assembly at said charging position for receiving fibers from a fiber supply source;

a tramper foot assembly for tramping fibers into said first lift box assembly at said charging position during a charging cycle to form a compacted fiber mass containing a desired amount of fibers;

a reciprocating main platen for compressing a compacted fiber mass in said second lift box assembly to form a compressed fiber bale during a compression cycle;

a bottom sill disposed underneath said second lift box assembly at said compression position; and a latch assembly carried by each said lift box assembly having a latched position in which said lower platen and lift box are integrally attached, and an unlatched position in which said lower platen may be displaced vertically to rest against said bottom sill for support during said compression of said fiber mass by said main platen during said compression cycle.

2. The apparatus of claim 1 wherein said latch assembly comprises a latch, a movable latching bar, and an actuator for moving said latching bar to engage said latch for latching and unlatching said lower platen and lift box.

3. The apparatus of claim 2 wherein said latch assembly comprises:

said latch having a hook and a foot;

said latching bar including a first tang and a second tang; and said actuator moves said latching bar so that said latching bar has a first position in which said foot is disposed between said first and second tangs in a non-contracting relation so that said latched lower platen and lift box may rotate relative to said frame, a second position in which said second tang engages said foot to move said hook to an unlatched position, and a third position in which said first tang engages said foot to move said hook to said latched position.

4. The apparatus of claim 2 wherein said actuator moves said latching bar so that said latching bar has a first position in which said lower platen and lift box are latched and may rotate relative to said frame, a second position in which said latch is in an unlatched position, and a third position in which said latch is in a latched position.

5. The apparatus of claim 2 including a spring for assisting in retaining said latch in a latched position.

6. The apparatus of claim 1 wherein said latch comprises a first latch part carried by said lower platen and a second latch part carried by said lift box wherein said first and second latch parts engage to integrally attach said lower platen to said lift box in said latched position.

7. The apparatus of claim 1 wherein said displaceable mount comprises a spring mount which resiliently mounts said lower platen for vertical displacement relative to said lift box.

8. The apparatus of claim 7 wherein said spring mount comprises a first part carried by said lower platen, a second part carried by said frame, a vertical post extending through said first and second parts, and a plurality of beveled washers carried by said vertical post which compress to allow said lower platen to be displaced downwardly.

9. The apparatus of claim 1 including a lift mechanism for raising said lower platen to a latching position relative to said lift box so that said latch may be moved to said latched position.

10. The apparatus of claim 9 wherein said lift mechanism comprises a hydraulic lifting cylinder.

11. The apparatus of claim 1 including a reversible ejector assembly for ejecting a strapped bale from either side of said baler.

12. The apparatus of claim 11 wherein said ejector assembly comprises an ejector plate, a pivot for pivotally attaching said ejector plate to said lower platen, and a moveable pivot amount which allows for said pivot to be attached into a first side position or a second side position so that said strapped bales may be ejected to a first side of baler when said pivot is mounted in said first side position and to a second side of said baler when said pivot is mounted in said second side position.

13. The apparatus of claim 1 including:

a rotating standard carried by said frame, and said first and second lift boxes being carried by said standard;

a drive wheel carried by said standard;

a drive motor for driving said drive wheel; and a drive transmission connecting said drive motor and said drive wheel for rotating said standard between said charging and compression positions.

14. The apparatus of claim 13 including a connector flange carried by said standard; and a drive wheel includes a split drive sprocket having two sprocket halves affixed to said connector flange; and said drive transmission comprises a drive chain connected to said drive chain.

15. The apparatus of claim 1 including:

a dog assembly having a plurality of fiber retaining dogs having a closed position for retaining said compacted fiber mass which has been tramped by said tramper foot assembly;

a dog assembly actuator for moving said fiber retaining dogs to an open position which allows passage of said main platen; and said main platen comprising spaced vertically extending wing sections for engaging said dog assembly actuator in vertical reciprocating motions for maintaining said fiber retaining dogs in said open position.

16. The apparatus of claim 15 wherein said dog actuator comprises a pair of laterally spaced fiber retaining dogs which are in alignment with said wing sections for engagement with said wing sections to maintain said dog assembly in said open position.

17. A double lift box fiber baler which includes a frame; a first lift box assembly rotatably carried relative to said frame between a charging position and a compression position; a second lift box assembly rotatably carried relative to said frame between a charging position and a compression position; a tramper box assembly disposed above said first lift box assembly at said charging position for receiving fibers from a fiber supply source; a tramper foot assembly for tramping fibers into said first lift box assembly at said charging position during a charging cycle to form a compacted fiber mass containing a desired amount of fibers; a reciprocating main platen for compressing a compacted fiber mass in said second lift box assembly to form a compressed fiber bale during a compression cycle; wherein said apparatus comprises:

a bottom sill disposed underneath said second lift box assembly at said compression position, and said bottom sill extending laterally across only a portion of a width of said frame;

each of said first and second lift box assemblies including a lift box, and a vertically displaceable lower platen forming a floor of said lift box; and a mount assembly for mounting said lower platen for vertical displacement relative to said lift box so that said lower platen has a normal position in which said lower platen and lift box are integrally attached, and a lowered position in which said lower platen may be displaced vertically to rest against said bottom sill for support during said compression of said fiber mass by said main platen during said compression cycle.

18. The apparatus of claim 17 wherein said mount assembly includes a latch having a first position in which said lower platen and lift box are latched and may rotate relative to said frame, a second position in which said latch is in an unlatched position so that said lower platen may move vertically relative to said lift box.

19. The apparatus of claim 18 including a lift mechanism for raising said lower platen to a latching position relative to said lift box so that said latch may be moved to said first position.

20. The apparatus of claim 18 wherein said latch comprises a first latch part carried by said lower platen and a second latch part carried by said lift box wherein said first and second latch parts engage to integrally attach said lower platen to said lift box in said latched position.

21. The apparatus of claim 17 wherein said mount assembly includes a displaceable mount comprises a spring mount which resiliently mounts said lower platen for vertical displacement relative to said lift box.

22. The apparatus of claim 21 wherein said spring mount comprises a first part carried by said lower platen, a second part carried by said frame, a vertical post extending through said first and second parts, and a plurality of beveled washers carried by said vertical post which compress to allow said lower platen to be displaced downwardly.

23. The apparatus of claim 17 including a reversible ejector assembly for ejecting a strapped bale from either side of said baler.

24. The apparatus of claim 17 including a dog assembly for retaining said compacted fiber mass which has been tramped by said tramper foot assembly;

a dog assembly actuator for opening said dog assembly to allow passage of said main platen in an open position; and said main platen comprising spaced vertically extending wing sections for engaging said dog assembly actuator in vertical reciprocating motions for maintaining said dog assembly in said open position.

25. The apparatus of claim 24 wherein said dog actuator comprises a pair of laterally spaced fiber retaining dogs which are in alignment with said wing sections for+engagement with said wing sections to maintain said dog assembly in said open position.

26. A double lift box fiber baler including a frame; a first lift box assembly rotatably carried relative to said frame between a charging position and a compression position; a second lift box assembly rotatably carried relative to said frame between a charging position and a compression position; a tramper box assembly disposed above said first lift box assembly at said charging position for receiving fibers from a fiber supply source; a tramper foot assembly for tramping fibers into said first lift box assembly at said charging position during a charging cycle to form a compacted fiber mass containing a desired amount of fibers; a reciprocating main platen disposed above said second lift box assembly for compressing a compacted fiber mass in said second lift box assembly to form a compressed fiber bale during a compression cycle;

a bottom sill disposed underneath said second lift box assembly at said compression position;

said first lift box assembly including a first lift box, and a vertically displaceable first lower platen forming a floor of said lift box;

said second lift box assembly including a second lift box, and a vertically displaceable second lower platen forming a floor of said lift box;

said first lower platen and said second lower platen being independently carried by said respective first and second lift box assemblies for independent vertical movement; and each said lower platen has a normal position in which said lower platen and lift box are integrally attached for rotation, and a lowered position in which said lower platen is displaced vertically to rest against said bottom sill for support during said compression of said fiber mass by said main platen during said compression cycle.

27. The apparatus of claim 26 including a latch having a first position in which said lower platen and lift box are latched and may rotate relative to said frame, a second position in which said latch is in an unlatched position so that said lower platen may move vertically relative to said lift box.

28. The apparatus of claim 27 including a lift mechanism for raising said lower platen to a latching position relative to said lift box so that said latch may be moved to said first position.

29. The apparatus of claim 27 wherein said latch comprises a first latch part carried by said lower platen and a second latch part carried by said lift box wherein said first and second latch parts engage to integrally attach said lower platen to said lift box in said latched position.

30. The apparatus of claim 27 including a displaceable mount comprising a spring mount which resiliently mounts said lower platen for vertical displacement relative to said lift box.

31. The apparatus of claim 30 wherein said spring mount comprises a first part carried by said lower platen, a second part carried by said frame, a vertical post extending through said first and second parts, and a plurality of beveled washers carried by said vertical post which compress to allow said lower platen to be displaced downwardly.

32. The apparatus of claim 26 including a dog assembly for retaining said compacted fiber mass which has been tramped by said tramper foot assembly;

a dog assembly actuator for opening said dog assembly to allow passage of said main platen in an open position; and said main platen comprising spaced vertically extending wing sections for engaging said dog assembly actuator in vertical reciprocating motions for maintaining said dog assembly in said open position.

33. The apparatus of claim 32 wherein said dog actuator comprises a pair of laterally spaced fiber retaining dogs which are in alignment with said wing sections for engagement with said wing sections to maintain said dog assembly in said open position, and said spaced dogs are constructed from a wear resistant material.

* * * * *